US010302279B2

(12) United States Patent
Rossi et al.

(10) Patent No.: US 10,302,279 B2
(45) Date of Patent: May 28, 2019

(54) LIGHT CONVERSION MODULES HAVING A LASER DIODE LIGHT CONVERSION ASSEMBLY AND LONG PASS FILTER REFLECTING LIGHT BACK TO THE LIGHT CONVERSION ASSEMBLY

(71) Applicant: ams Sensors Singapore Pte. Ltd., Singapore (SG)

(72) Inventors: Markus Rossi, Jona (CH); Peter Riel, Bach (CH); Peter Roentgen, Thalwil (CH)

(73) Assignee: ams Sensors Singapore Pte. Ltd., Singapore (SG)

( * ) Notice: Subject to any disclaimer, the term of this patent is extended or adjusted under 35 U.S.C. 154(b) by 0 days.

(21) Appl. No.: 15/618,253

(22) Filed: Jun. 9, 2017

(65) Prior Publication Data

US 2017/0356622 A1 Dec. 14, 2017

Related U.S. Application Data

(60) Provisional application No. 62/348,328, filed on Jun. 10, 2016.

(51) Int. Cl.

| | |
|---|---|
| ***F21V 9/08*** | (2018.01) |
| ***F21V 5/00*** | (2018.01) |
| ***F21V 7/22*** | (2018.01) |
| ***F21V 9/30*** | (2018.01) |
| *F21Y 115/30* | (2016.01) |

(52) U.S. Cl.

CPC ..... *F21V 9/08* (2013.01); *F21V 5/004* (2013.01); *F21V 7/22* (2013.01); *F21V 9/30* (2018.02); *F21Y 2115/30* (2016.08)

(58) Field of Classification Search

CPC ... F21V 9/30; F21V 9/04; F21V 5/004; F21Y 2115/30

See application file for complete search history.

(56) References Cited

U.S. PATENT DOCUMENTS

| | | | | |
|---|---|---|---|---|
| 8,858,048 | B2 * | 10/2014 | Nakazato | F21S 41/125 362/510 |
| 8,960,917 | B2 * | 2/2015 | Tseng | G03B 21/2013 349/5 |
| 9,103,517 | B2 * | 8/2015 | Nakazato | F21S 48/1145 |
| 9,869,442 | B2 * | 1/2018 | Bhakta | F21S 41/36 |
| 9,958,126 | B2 * | 5/2018 | Wang | F21S 41/675 |
| 2017/0148139 | A1 | 5/2017 | Cutu et al. | |

FOREIGN PATENT DOCUMENTS

| | | |
|---|---|---|
| WO | WO 2016/039689 | 3/2016 |
| WO | WO 2016/039690 | 3/2016 |
| WO | WO 2017/023208 | 2/2017 |

* cited by examiner

*Primary Examiner* — Robert J May
(74) *Attorney, Agent, or Firm* — Fish & Richardson P.C.

(57) ABSTRACT

The present disclosure describes light conversion modules each having a single laser diode or multiple laser diodes. The light conversion modules can be particularly small in size (height and lateral footprint) and can overcome various challenges associated with the high optical power and heat emitted by laser diodes. In some implementations, the light conversion modules include glass phosphors, which, in some instances, can resist degradation caused by the optical power and/or heat generated by the laser diodes. In some instances, the light conversion modules include optical filters which, in some instances, can reduce or eliminate human eye-safety risk.

10 Claims, 7 Drawing Sheets

LIGHT CONVERSION MODULES HAVING A LASER DIODE LIGHT CONVERSION ASSEMBLY AND LONG PASS FILTER REFLECTING LIGHT BACK TO THE LIGHT CONVERSION ASSEMBLY

CROSS-REFERENCE TO RELATED APPLICATION(S)

This application claims the benefit of priority of U.S. Provisional Patent Application No. 62/348,328, filed on Jun. 10, 2016. The contents of the earlier application are incorporated herein by reference in their entirety.

BACKGROUND

Light conversion modules or light converters are configured to convert the wavelength or range of wavelengths of a light emission generated from a light source to another wavelength or range of wavelengths (i.e., a converted light emission). For example, a light conversion module such as a camera flash can include a light-emitting diode (LED) and a phosphor (e.g., $Ce^{+}$:YAG). In some instances, the phosphor may be suspended in a matrix such as silicone or another polymer, wherein the matrix ideally maintains high optical transmittance over the lifetime of the phosphor or light conversion module. During operation of such a light conversion module, the LED generates a light emission of a particular wavelength. When the light emission illuminates the phosphor, the phosphor can generate a converted light emission of another wavelength or range of wavelengths. In some instances, the converted light emission may be more functionally suited or aesthetically pleasing than the light emission generated by the LED. For example, an LED may be configured to emit ultraviolet light, which is invisible to humans, onto a phosphor configured to convert the ultraviolet light to a longer wavelength (or range of wavelengths), which is visible to humans. Such a process has readily apparent implications for applications such as camera flashes, interior lighting, and automotive headlights. In some instances, light emissions characterized by shorter wavelengths, such as ultraviolet light, permit the use of a wider range of phosphors. Indeed, this can be a distinct advantage for various applications such as camera flashes, interior lighting, and automotive head-lighting.

Light conversion modules that use LEDs, however, experience a number of limitations. For example, LEDs are typically characterized by low optical power. Accordingly, a light conversion module would need to include a large volume of phosphor in order to achieve a desired optical output. Large phosphor volumes necessarily lead to a corresponding increase in the size (i.e., height and/or lateral footprint) of such a light conversion module.

Compared to LEDs, other light sources such as laser diodes can exhibit far greater optical power; however, laser diodes implemented in light conversion modules can present a number of significant challenges. For example, in some instances the optical power and heat generated by a laser diode could be sufficient to degrade the phosphor matrix thereby reducing the light conversion efficiency (i.e., quantum yield) of the phosphor or generating an undesirable chromatic shift in the converted light emission. Some of the aforementioned are well-established challenges observed in light conversion modules utilizing LEDs characterized by even moderately low optical power. Further, the aforementioned challenges can be particularly acute for light sources configured to emit ultraviolet light, wherein certain chemical bonds within the matrix molecules (e.g., the bonds in silicone to methyl functional groups) may be particularly susceptible to degradation. Finally, light sources with high optical power, such as laser diodes, may present a human eye-safety risk.

SUMMARY

The present disclosure describes light conversion modules each having a single laser diode or multiple laser diodes. The light conversion modules can be particularly small in size (height and lateral footprint) and can overcome various challenges associated with the high optical power and heat emitted by laser diodes. In some implementations, the light conversion modules include glass phosphors, which, in some instances, can resist degradation caused by the optical power and/or heat generated by the laser diodes. In some instances, the light conversion modules include optical filters which, in some instances, can reduce or eliminate human eye-safety risk. The light conversion modules in the present disclosure can be suitable for a number of applications; for example, a camera flash, as integrated in smartphone, tablet or other portable devices; interior lighting; and automotive head-lighting.

Other aspects, features and advantages will be readily apparent from the following detailed description, the accompanying drawings and the claims.

DETAILED DESCRIPTION

Figure 1A:
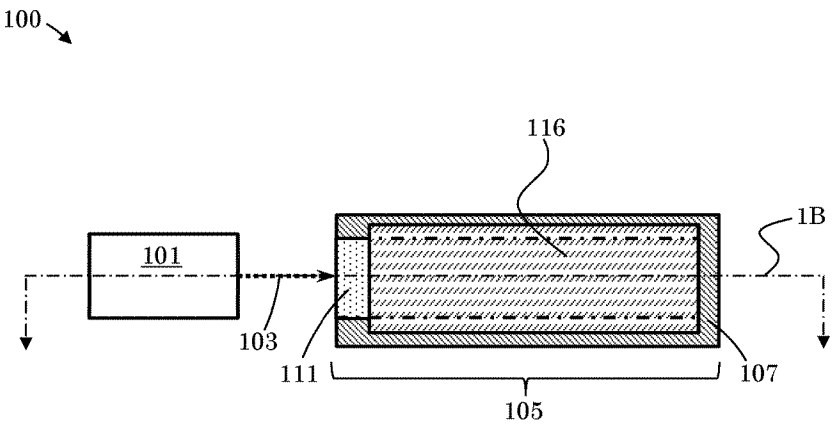
FIGS. 1A-1C depict an example of a light conversion module including a single laser diode.
Figure 1B:
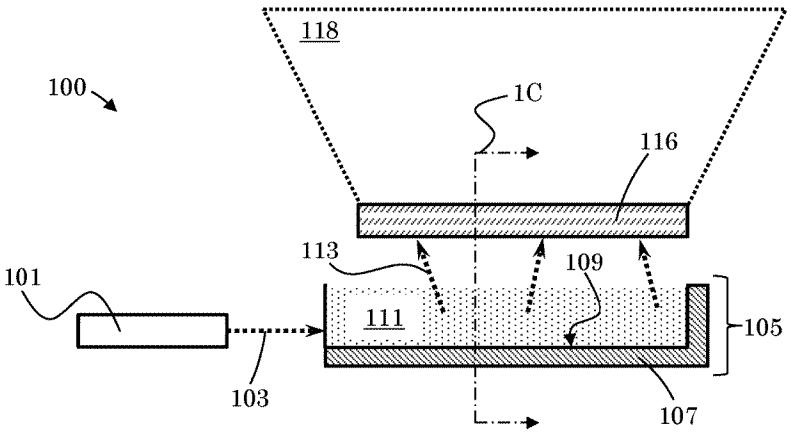
Figure 1C:
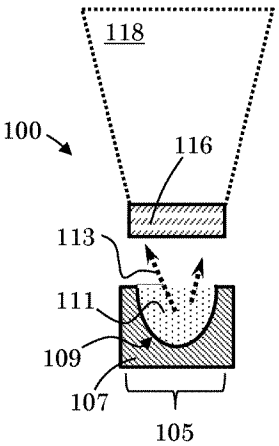

FIG. 1A-FIG. 1C depict an example light conversion module 100 including a single laser diode 101. The laser diode 101 can be implemented, for example, as a vertical-cavity surface-emitting laser diode, an edge-emitting laser, or an array of vertical-cavity surface-emitting laser diodes or edge-emitting diodes. The laser diode 101 is operable to generate a light emission 103 of a particular wavelength or range of wavelengths. For example, in some instances the light emission 103 can be infrared or ultraviolet (e.g., 405 nm).

The light conversion module 100 further includes a light conversion assembly 105. The light conversion assembly 105 includes a holder 107, at least one optically active surface 109, and a light conversion material 111. The holder 107 can be configured to hold or contain the light conversion material 111 and at least one interior surface of the holder 111 can be an optically active surface 109. The optically active surface 109 can be reflective and/or diffusive. For example, in some instances the optically active surface 109 can be a metal with particularly high reflectivity. In some instances the optically active surface 109 can be composed, at least partially, of a white material such as titanium or zinc oxide. Further, the holder 107 and/or optically active surface 109 can be configured to transmit the light emission 103 such that the light emission 103 illuminates the light conversion material 111.

The light conversion material 111 can be any material that is capable of converting the light emission 103 to a converted light emission 113 of another wavelength. For example, the light conversion material 111 can be a phosphor, a fluorescent material, luminescent material, and/or any other organic or inorganic semiconductor. Further, the light conversion material 111 can include a matrix composed, at least in part, from material such as silicone or another polymer in some implementations. In some implementations the light conversion material 111 can include a matrix composed, at least in part, from inorganic glasses such as silicate-, sodium-, borate-, and/or tellurite-glasses. Other matrixes are within the scope of the present disclosure such as matrices composed, at least in part, of materials exhibiting good optical transmittance, thermal stability, high thermal conductivity, and low thermal expansion coefficients. In some instances the light conversion material 111 can be $Ce^{3+}$:YAG doped sodium glass (CE YDG).

The holder 107 can be disposed relative to the laser diode 101, such that the light emission illuminates the light conversion material 111, wherein the light conversion material 111 generates the converted light emission 113. Further, the holder 107 and/or the optically active surface 109 can be operable to transmit the converted light emission 113. In some implementations the holder 107 can be composed of epoxy or another polymer, and can be formed via a wafer-level process such as vacuum injection molding, injection molding, or other molding techniques. The holder 107 can be coated, in some implementations, with a layer of metal to form the optically active surface 109. The holder 107 and/or the optically active surface 109 are operable to direct (e.g., focus) the light emission 103 and/or the converted light emission 113 through the holder 107 in order to achieve high conversion efficiency. For example, in some implementations, the holder 107 and/or the optically active surface 109 can be parabolic or trough shaped as depicted in FIGS. 1A-1C, wherein the parabolic or trough shape permits recycling of the light emission 103 throughout the light conversion assembly 105 and/or focusing of the light emission 113 to an optical assembly 116.

Accordingly, the converted light emission 113 is incident on the optical assembly 116 as illustrated in FIG. 1B and FIG. 1C. The optical assembly 116 can be operable to direct the converted light emission 113 over a pre-defined field-of-illumination as a directed light emission 118. In some implementations the optical assembly 116 is operable to focus the converted light emission 113 while in other instances the optical assembly 116 is operable to de-magnify the converted light emission 113. The optical assembly 116 can include refractive and/or diffractive optical elements and/or array of refractive and/or diffractive optical elements (e.g., a microlens array), in some implementations. In some implementations the optical assembly 116 can be a diffuser.

Figure 2A:
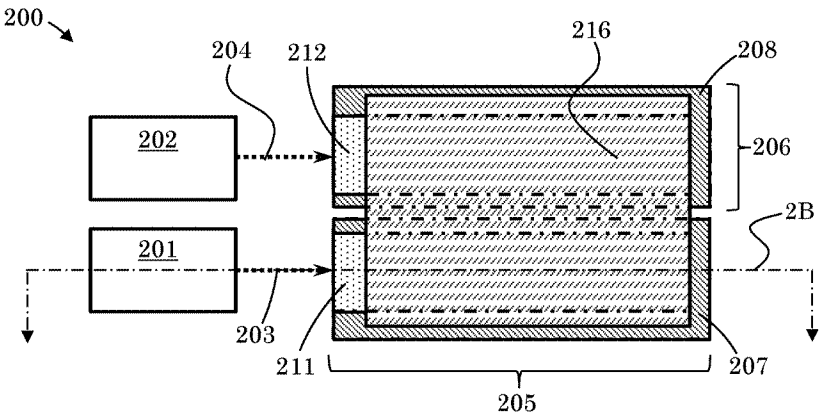
FIGS. 2A-2C depict an example of a light conversion module including multiple laser diodes.
Figure 2B:
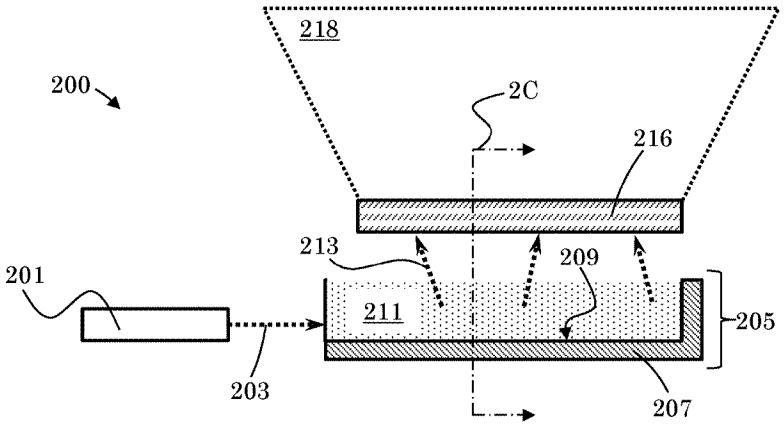
Figure 2C:
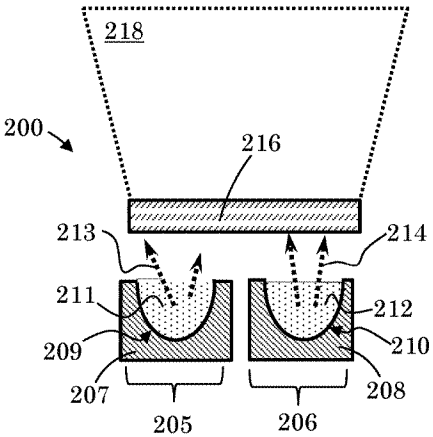

FIG. 2A-FIG. 2C depict an example light conversion module 200 including multiple laser diodes 201, 202. The laser diodes 201, 202 can be implemented, for example, as vertical-cavity surface-emitting laser diodes, edge-emitting lasers, or arrays of vertical-cavity surface-emitting laser diodes or edge-emitting diodes. The laser diodes 201, 202 are each operable to generate light emissions 203, 204, respectively, each of a particular wavelength or range of wavelengths. For example, in some instances the light emissions 203, 204 can be infrared or ultraviolet (e.g., 405 nm). In some implementations, the lasers diodes 201, 202 can each be operable to generate light emissions 203, 204, respectively, each having the same or different wavelengths or ranges of wavelengths. The light conversion module of the present disclosure is not limited to two lasers diodes as depicted in FIG. 2 and could include more than two laser diodes in other implementations.

The light conversion module 200 further includes light conversion assemblies 205, 206. The light conversion assemblies 205, 206 each include holders 207, 208, respectively, at least one optically active surface 209, 210, respectively, and light conversion materials 211, 212, respectively. The holders 207, 208 can each be configured to hold or contain light conversion materials 211, 212, respectively; and at least one interior surface of each of the holders 211, 212, respectively can be optically active surfaces 209, 210, respectively. The optically active surfaces 209, 210 can each be reflective and/or diffusive. For example, in some instances the optically active surfaces 209, 210 can each be metal with particularly high reflectivity. In some instances the optically active surfaces 209, 210 can each be composed, at least partially, of a white material such as titanium or zinc oxide. Further, the holders 207, 208 and/or respective optically active surfaces 209, 210 can each be configured to transmit the light emissions 203, 204, respectively, such that the light emissions 203, 204 each illuminate the light conversion materials 211, 212, respectively.

The light conversion materials 211, 212 can each be any material that is capable of converting the light emissions 203, 204 to converted light emissions 213, 214, respectively, of another wavelength. For example, the light conversion materials 211, 212 can each be a phosphor, a fluorescent material, luminescent material, and/or any other organic or inorganic semiconductor. Further, the light conversion materials 211, 212 can each include a matrix composed, at least in part, from material such as silicone or another polymer in some implementations. In some implementations the light conversion materials 211, 212 can each include a matrix composed, at least in part, from inorganic glasses such as silicate-, sodium-, borate-, and/or tellurite-glasses. Other matrixes are within the scope of the present disclosure such as matrices composed, at least in part, of materials exhibiting good optical transmittance, thermal stability, high thermal conductivity, and low thermal expansion coefficients. In some instances the light conversion materials 211, 212 can each be $Ce^{3+}$:YAG doped sodium glass (CE YDG).

The holders 207, 208 can each be disposed relative to the laser diodes 201, 202, respectively, such that each of the light emissions 203, 204 illuminate the light conversion materials 211, 212, respectively, wherein the light conversion materials 211, 212 each generate the converted light emissions 213, 214, respectively. Further, each of the holders 207, 208 and/or the respective optically active surfaces 209, 210 can be operable to transmit the converted light emissions 213, 214, respectively. In some implementations each of the holders 207, 208 can be composed of epoxy or another polymer, and can be formed via a wafer-level process such as vacuum injection molding, injection molding, or other molding techniques. Each of the holders 207, 208 can be coated, in some implementations, with a layer of metal to form the optically active surfaces 209, 210, respectively. The holders 207, 208 and/or the optically active surfaces 209, 210 are operable to respectively direct (e.g., focus) the light emissions 203, 204 and/or the converted light emissions 213, 214 through the holders 207, 208 in order to achieve high conversion efficiency. For example, in some implementations, the holders 207, 208 and/or the optically active surfaces 209, 210 can be parabolic or trough shaped as depicted in FIGS. 2A-2C, wherein the parabolic or trough shape permits recycling of the light emissions 203, 204 throughout the light conversion assemblies 205, 206 and/or focusing of the light emissions 213, 214 to an optical assembly 216.

Accordingly, the converted light emissions 213, 214 are each incident on the optical assembly 216 as illustrated in FIG. 2B and FIG. 2C. The optical assembly 216 can be operable to direct the converted light emissions 213, 214 over a pre-defined field-of-illumination as a directed light emission 218. In some implementations the optical assembly 216 is operable to focus the converted light emission 213 while in other instance the optical assembly 216 is operable to de-magnify the converted light emission 213. The optical assembly 216 can include refractive and/or diffractive optical elements or/and array of refractive and/or diffractive optical elements (e.g., microlens array), in some implementations. In some implementations the optical assembly 216 can be a diffuser. In some implementations the optical assembly can homogenize the converted light emissions 213, 214.

Figure 3A:
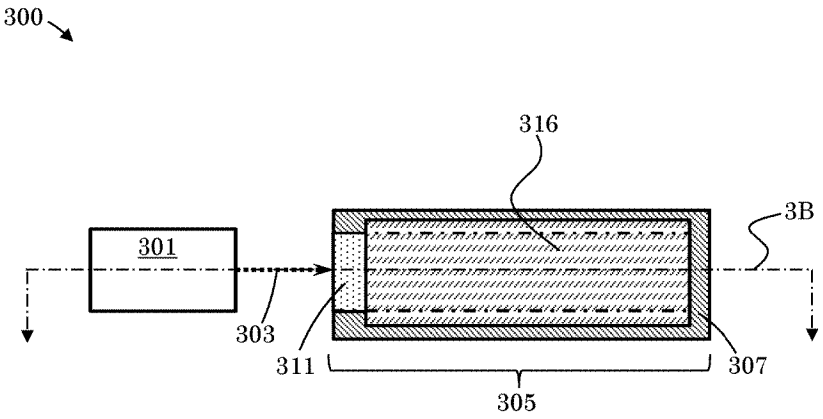
FIGS. 3A-3C depict another example of a light conversion module including a single laser diode.
Figure 3B:
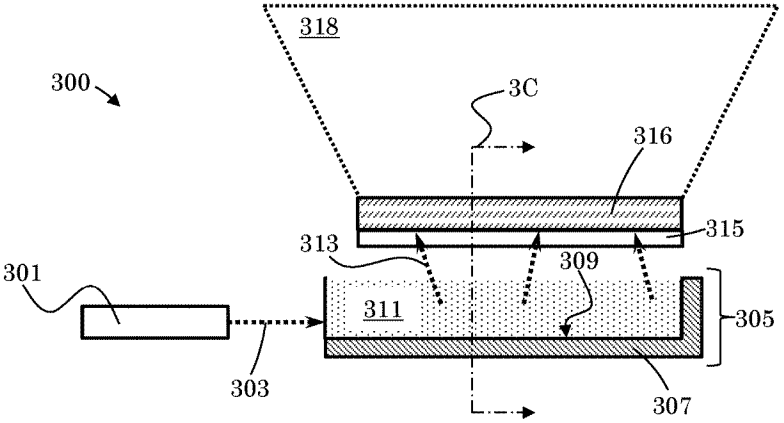
Figure 3C:
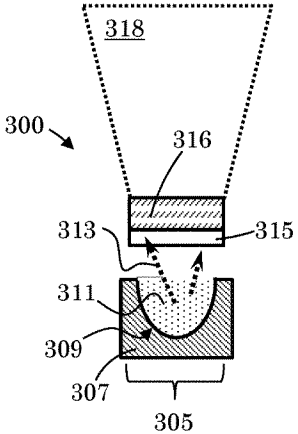

FIGS. 3A-3C depict another example of a light conversion module 300 including a single laser diode 301. The light conversion module 300 operates in a similar way to the light conversion modules disclosed above. Accordingly, the light conversion module includes a laser diode 301 operable to generate a light emission 303, a light conversion assembly 305, a holder 307, an optically active surface 309, a light conversion material 311 operable to convert the light emission 303 to a converted light emission 313, an optical assembly 316, and a directed light emission 318. However, the light conversion module 300 illustrated in FIGS. 3A-3C includes an optical filter 315. The optical filter 315 can be implemented as a long-pass optical filter wherein light of a long wavelength (e.g., converted light emission 313) is permitted to pass and illuminate the optical assembly 316 in some implementations. The optical filter 315 can reflect light of a short wavelength (e.g., the light emission 303). The optical filter 315 can improve efficiency in some instances by recycling portions of the light emission 303 that are not converted to the converted light emission 313. In some instances the optical filter 315 can improve eye-safety.

Figure 4A:
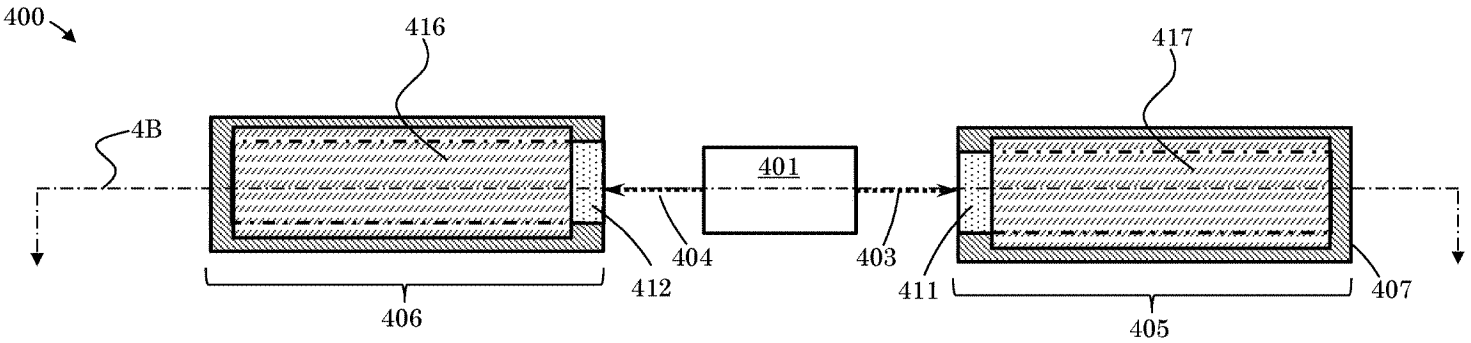
FIG. 4A and FIG. 4B depict another example of a light conversion module.
Figure 4B:
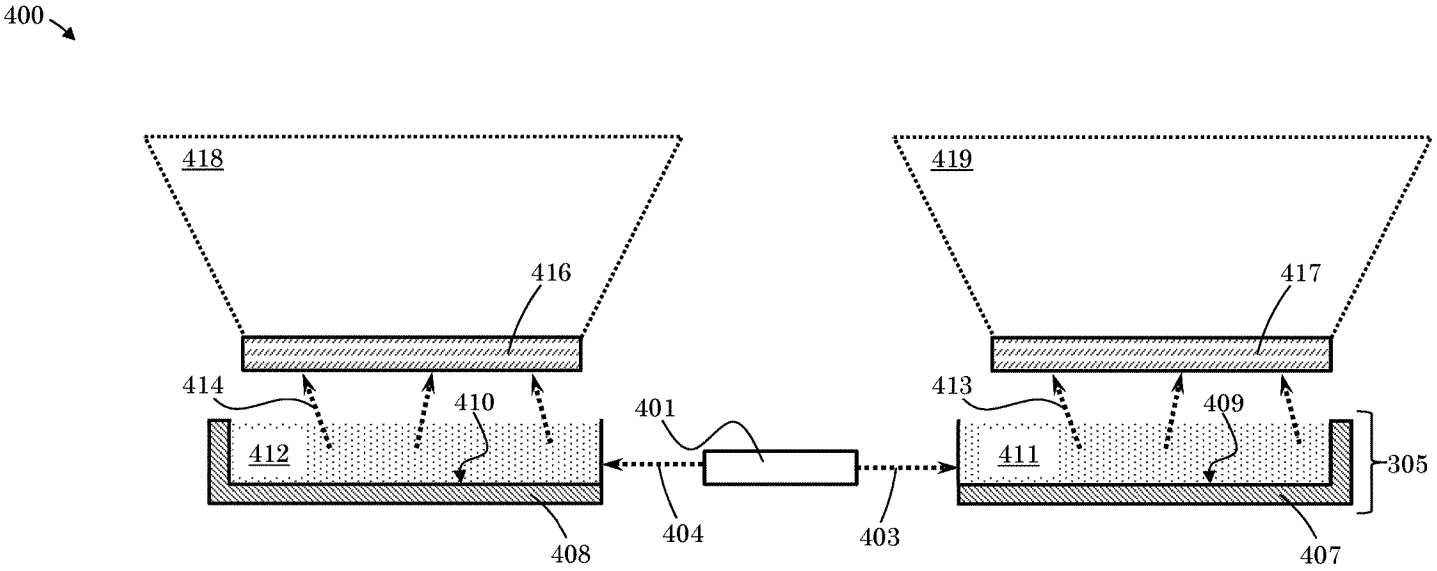

FIGS. 4A-4C depict another example of a light conversion module 400 including a laser diode 401. The light conversion module 400 operates in a similar way to the light conversion modules disclosed above. However, the laser diode 401 is operable to generate both a first light emission 403 and a second light emission 404. In some implementations the optical power of the first and second light emissions 403, 404 can be different or the same. In some implementations the wavelength or range of wavelengths of the first light emission 403 and second light emission 404 can be different or the same.

The light conversion module 400 includes light conversion assemblies 405, 406, holders 407, 408, optically active surfaces 409, 410, light conversion materials 411, 412 operable to respectively convert the first light emission 403 and the second light emission 404 to respective converted light emissions 413, 414, optical assemblies 416, 417 operable to respectively direct the first and second converted light emissions 413, 414 thereby generating directed light emissions 418, 419. In some implementations the light conversion materials 411, 412 can be different or the same. In implementations where the light conversions materials 411, 412 are different (i.e., their respective converted light emissions 413, 414 are composed of different wavelengths or ranges of wavelengths), the directed light emissions 418, 419 can be tuned to achieve a more functionally suited or aesthetically pleasing affect.

Figure 5:
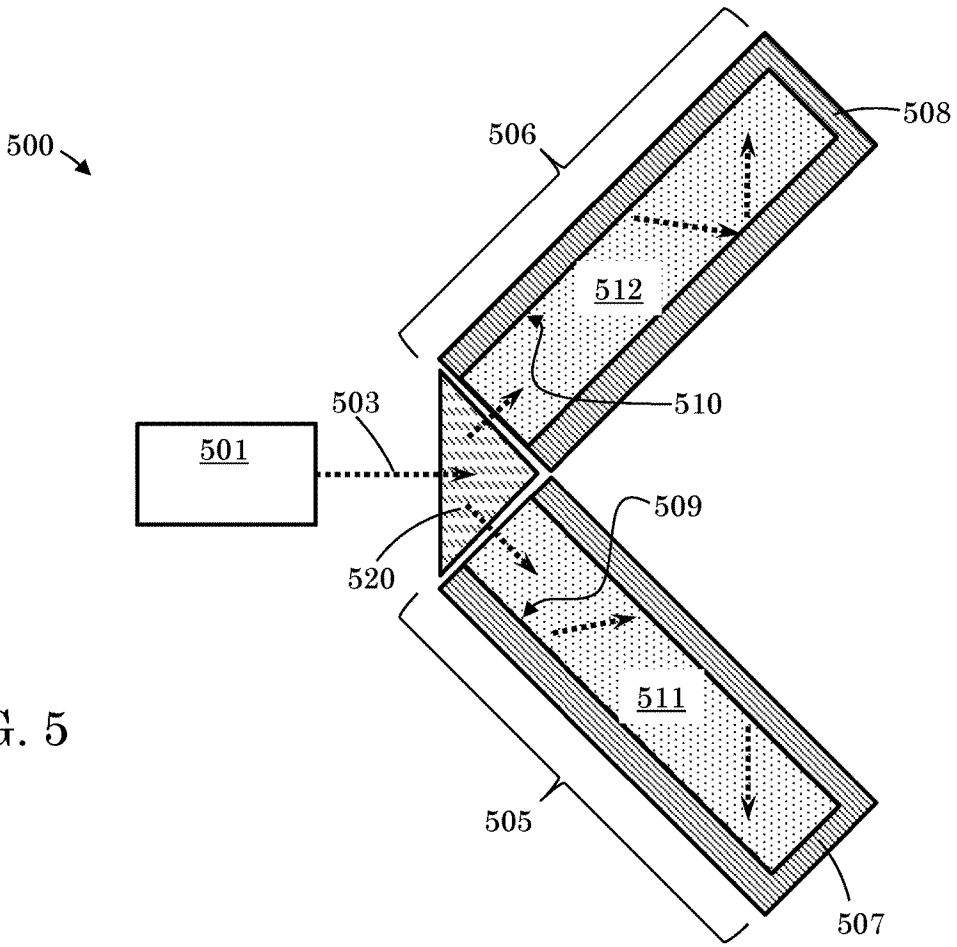
FIG. 5 depicts yet another example of a light conversion module.

FIG. 5 depicts another example of a light conversion module 500 including a laser diode 501. The light conversion module 500 operates in a similar way to the light conversion modules disclosed above, for example, the laser diode 501 is operable to generate a light emission 503. However, the light conversion module 500 includes a modulator 520. The light conversion module 500 further includes two light conversion assemblies 505, 506. The modulator 520 is operable to modulate and/or direct the light emission 503 to either one or both the light conversion assemblies 505, 506. Each light conversion assembly 505, 506, respectively include holders 507, 508, optically active surfaces 509, 510, light conversion materials 511, 512, respectively operable to convert light emissions 503, 504 into converted light emissions 513, 514. A single contiguous optical assembly disposed over light conversion assemblies 505, 506 or two dedicated optical assemblies disposed over light conversion assemblies 505, 506, respectively, are not depicted in FIG. 5. In some implementations the light conversion materials 511, 512 can be different or the same. In implementations where the light conversion materials 511, 512 are different (i.e., their respective converted light emissions 513, 514 are composed of different wavelengths or ranges of wavelengths), the directed light emissions (not depicted in FIG. 5) can be tuned via the modulator 520 to achieve a more functionally suited or aesthetically pleasing affect.

Figure 6:
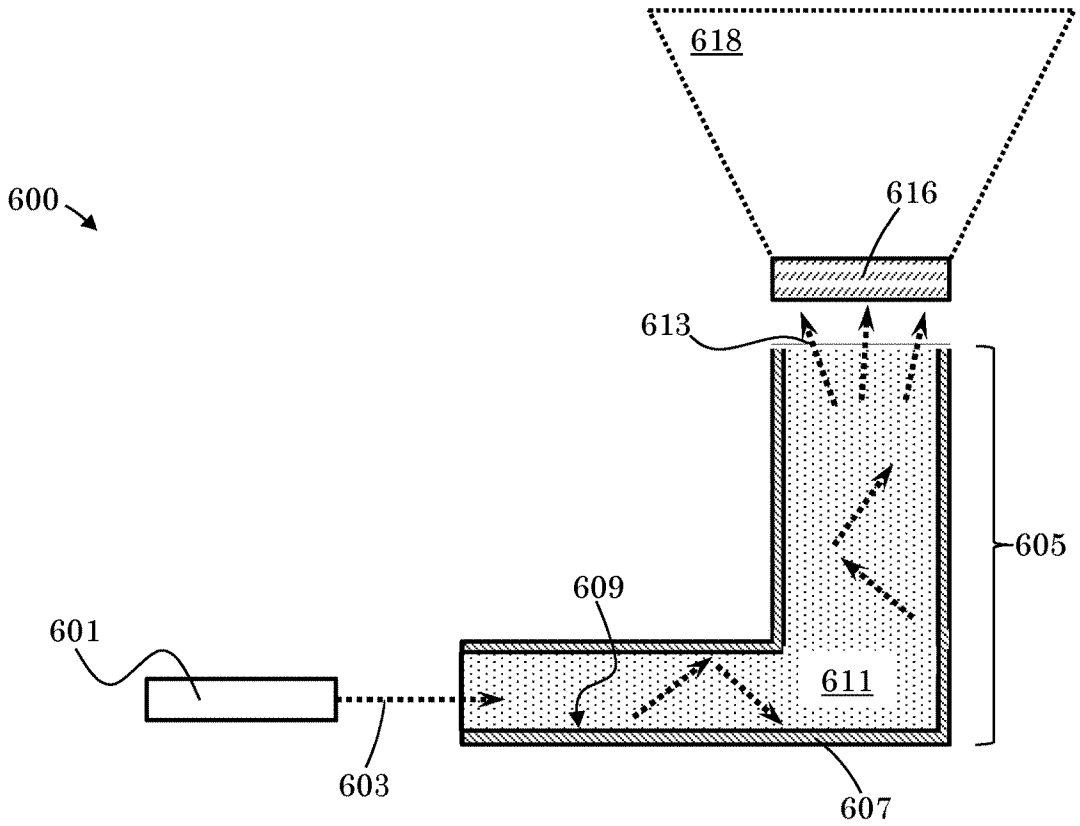
FIG. 6 depicts still yet another example of a light conversion module.

FIG. 6 depicts still yet another example of a light conversion module 600. The light conversion module 600 operates in a similar way to the light conversion modules disclosed above. Accordingly, during operation the light conversion module includes a laser diode 601 operable to generate a light emission 603, a light conversion assembly 605, a holder 607, an optically active surface 609, a light conversion material 611 operable to convert the light emission 603 to a converted light emission 613, an optical assembly 616 operable to direct the converted light emission 613 to a directed light emission 618. However, the light conversion assembly 605 is configured as an L-shaped light conversion assembly 605. In some implementations the L-shaped conversion assembly 605 can increase the volume of light conversion material 611 within the light conversion assembly 605 without increasing the lateral footprint of the light conversion module 600.

Figure 7A:
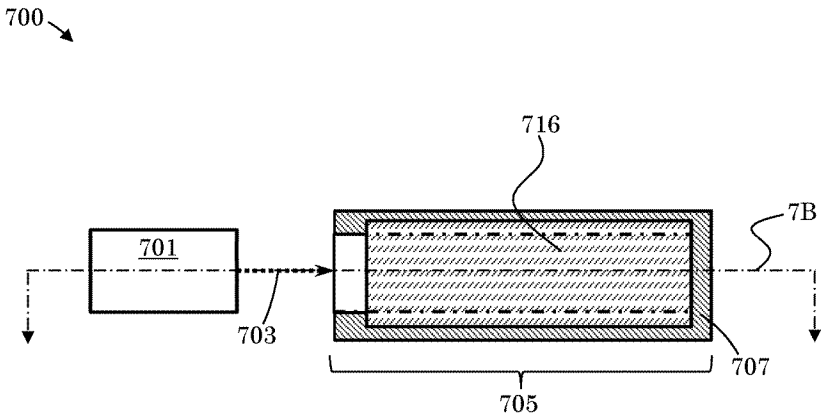
FIGS. 7A-7C depict still yet another example of a light conversion module
Figure 7B:
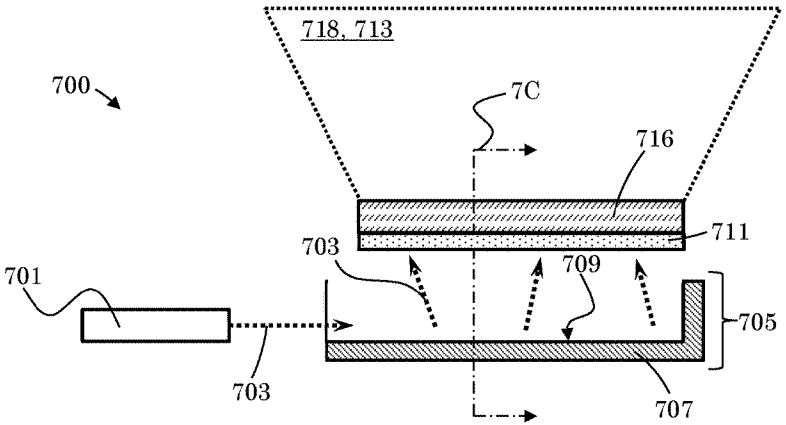
Figure 7C:
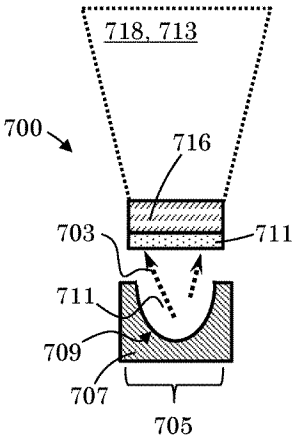

FIGS. 7A-7C depicts still yet another example of a light conversion module 700. The light conversion module 700 operates in a similar way to the light conversion modules disclosed above. Accordingly, during operation the light conversion module includes a laser diode 701 operable to generate a light emission 703, a light conversion assembly 705, a holder 707, an optically active surface 709, and a light conversion material 711 operable to convert the light emission 703 to a converted light emission 713. The light conversion module 700 further includes an optical assembly 716, and a directed light emission 718. In the example depicted in FIGS. 7A-7C, the light conversion material 711 is adjacent to the optical assembly 716, and not within the holder 707 as depicted in previous examples. Moreover, the converted emission 713 and the directed light emission 718 are depicted as being coincident in this example as the light conversion material 711 is adjacent to the optical assembly 716. In some implementations, such a configuration can permit use of a smaller volume of the light conversion material 711.

Various modifications can be made within the spirit of the present disclosure. For example, an optical filter could be implemented with any of the implementations disclosed above. Accordingly, other implementations are within the scope of the claims.

What is claimed is:

1. A light conversion module operable to generate a directed light emission comprising:

a laser diode operable to generate a light emission of a particular wavelength or range of wavelengths;

a light conversion assembly including a holder, an optically active surface, a light conversion material within the holder, the laser diode being disposed such that the light emission illuminates the light conversion material within the holder, wherein the light conversion material is operable to convert at least some of the light emission to a converted light emission, the optically active surface being diffusive and/or reflective and being operable to diffusively and/or spectrally reflect the light emission and the converted light emission;

a filter; and an optical assembly;

wherein the filter is arranged so as to allow the converted light emission to pass to the optical assembly, and is arranged such that at least some of an unconverted portion of the light emission is reflected back to the light conversion assembly, the optical assembly including a refractive and/or diffractive lens element, the optical assembly being operable to direct the converted light emission over a particular field-of-illumination thereby generating the directed light emission.

2. The light conversion module as in claim 1 wherein the optical filter is operable to pass wavelengths of light greater than a wavelength of the light emission.

3. The light conversion module as in claim 2 wherein the optical filter is operable to reflect wavelengths of light having a wavelength of light equal to or less than that of the light emission.

4. The light conversion module as in claim 3 wherein the optical filter is operable to reflect wavelengths of light having a wavelength of light equal to or less than that of the light emission back toward the light conversion assembly.

5. The light conversion module as in claim 4 configured such that at least some of the reflected light is recycled by the light conversion assembly.

6. A light conversion module operable to generate a directed light emission comprising:

a laser diode operable to generate a light emission of a particular wavelength or range of wavelengths;

a light conversion assembly including a holder, an optically active surface, a light conversion material, the laser diode being disposed such that the light emission illuminates the light conversion material, wherein the light conversion material is operable to convert at least some of the light emission to a converted light emission, the optically active surface being diffusive and/or reflective and being operable to diffusively and/or spectrally reflect the light emission and the converted light emission;

a filter; and an optical assembly;

wherein the filter is arranged so as to allow the converted light emission to pass to the optical assembly, and is arranged such that at least some of an unconverted portion of the light emission is reflected back to the light conversion assembly, the optical assembly including a refractive and/or diffractive lens element, the optical assembly being operable to direct the converted light emission over a particular field-of-illumination thereby generating the directed light emission.

7. The light conversion module as in claim 6 wherein the optical filter is operable to pass wavelengths of light greater than a wavelength of the light emission.

8. The light conversion module as in claim 7 wherein the optical filter is operable to reflect wavelengths of light having the wavelength of light equal to or less than that of the light emission.

9. The light conversion module as in claim 8 wherein the optical filter is operable to reflect wavelengths of light having a wavelength of light equal to or less than that of the light emission back toward the light conversion assembly.

10. The light conversion module as in claim 9 configured such that at least some of the reflected light is recycled by the light conversion assembly.

* * * * *